US008459973B2

(12) United States Patent
Sakakibara et al.

(10) Patent No.: US 8,459,973 B2
(45) Date of Patent: Jun. 11, 2013

(54) VANE PUMP HAVING AN OIL SUPPLY PASSAGE COMMUNICATING WITH A GAS PASSAGE IN THE STOPPING STATE

(75) Inventors: Ryuichi Sakakibara, Toyota (JP); Kiyotaka Ohtahara, Toyota (JP); Kikuji Hayashida, Toyota (JP); Yoshimasa Kuno, Toyota (JP)

(73) Assignee: Taiho Kogyo Co., Ltd., Toyota-shi, Aichi (JP)

( * ) Notice: Subject to any disclaimer, the term of this patent is extended or adjusted under 35 U.S.C. 154(b) by 66 days.

(21) Appl. No.: 13/138,451

(22) PCT Filed: Nov. 17, 2010

(86) PCT No.: PCT/JP2010/070443

§ 371 (c)(1),
(2), (4) Date: Aug. 17, 2011

(87) PCT Pub. No.: WO2011/135746

PCT Pub. Date: Nov. 3, 2011

(65) Prior Publication Data

US 2012/0076682 A1 Mar. 29, 2012

(30) Foreign Application Priority Data

Apr. 27, 2010 (JP) ..... 2010-102248

(51) Int. Cl.

| | |
|---|---|
| ***F03C 4/00*** | (2006.01) |
| ***F04C 15/00*** | (2006.01) |
| ***F04C 2/00*** | (2006.01) |
| ***F04C 27/02*** | (2006.01) |

(52) U.S. Cl.

USPC ..... 418/94; 418/98; 418/188; 418/255

(58) Field of Classification Search

USPC ..... 418/93–94, 96–100, 106, 150, 188, 418/253–255, 259, 266–268

See application file for complete search history.

(56) References Cited

U.S. PATENT DOCUMENTS

| | | | | |
|---|---|---|---|---|
| 7,628,595 | B2 * | 12/2009 | Ono et al. | 418/255 |
| 7,896,631 | B2 | 3/2011 | Kishi et al. | |
| 8,382,462 | B2 | 2/2013 | Kishi et al. | |
| 2008/0101975 | A1 | 5/2008 | Kishi et al. | |
| 2011/0064598 | A1 | 3/2011 | Kishi et al. | |

FOREIGN PATENT DOCUMENTS

| | | |
|---|---|---|
| JP | 05-066287 | 9/1993 |
| JP | 09-209927 | 8/1997 |
| JP | 2005256684 A * | 9/2005 |

(Continued)

OTHER PUBLICATIONS

Office Action of Korean Patent Office with English translation (5 pages)—Received on Dec. 5, 2012.

*Primary Examiner* — Theresa Trieu
(74) *Attorney, Agent, or Firm* — Flynn, Thiel, Boutell & Tanis, P.C.

(57) ABSTRACT

A vane pump 1 has a pump chamber 2A through an axial direction oil supply hole 11*a*, a diameter direction oil supply hole 11*b*, and an axial direction oil supply groove 11*c* of an oil supply passage 11. A gas passage 13 contains a gas groove 13*a* whose one end is made to communicate with an outer space, the gas groove 13*a* being formed on an outer peripheral surface of a shaft part 3B of a rotor 3, and the other end of this gas groove is made to intermittently overlappingly communicate with the axial direction oil supply groove 11*c* by a rotation of the rotor.

3 Claims, 4 Drawing Sheets

FOREIGN PATENT DOCUMENTS

| | | | |
|---|---|---|---|
| JP | 2006-118424 | 5/2006 | |
| JP | 2006-226164 | 8/2006 | |
| JP | 2009185699 A | * | 8/2009 |
| KR | 10-2007-0100794 | | 10/2007 |

* cited by examiner

VANE PUMP HAVING AN OIL SUPPLY PASSAGE COMMUNICATING WITH A GAS PASSAGE IN THE STOPPING STATE

TECHNICAL FIELD

The present invention relates to a vane pump and, more particularly, to a vane pump in which an oil supply passage through which a lubricating oil flows is formed inside a rotor, and in which the lubricating oil is intermittently supplied in a pump chamber by a rotation of the rotor.

BACKGROUND ART

Conventionally, a vane pump has been known, which includes: a housing including a substantially circular pump chamber; a rotor that rotates about a position eccentric with respect to a center of the pump chamber; a vane that is rotated by the rotor and that always partitions the pump chamber into a plurality of spaces; an oil supply passage that intermittently communicates with the pump chamber by the rotation of the rotor; and a gas passage that makes the pump chamber and an outer space communicate with each other when the oil supply passage communicates with the pump chamber by the rotation of the rotor, wherein the oil supply passage includes: a diameter direction oil supply hole provided at a shaft part of the rotor in a diameter direction thereof; and an axial direction oil supply groove that is provided in the housing to communicate with the pump chamber, and with which an opening of the diameter direction oil supply hole is made to intermittently overlappingly communicate by the rotation of the rotor. (Patent Document 1)

In the vane pump, the gas passage includes: a diameter direction gas hole that is provided at the shaft part of the rotor in the diameter direction thereof to communicate with the oil supply passage; and an axial direction gas groove that is provided in the housing to communicate with the outer space, and with which an opening of the diameter direction gas hole is made to intermittently overlappingly communicate by the rotation of the rotor, wherein the diameter direction gas hole is made to communicate with the axial direction gas groove when the diameter direction oil supply hole is made to communicate with the axial direction oil supply groove.

In the above-described vane pump, when the rotor stops in a state where the diameter direction oil supply hole of the oil supply passage is in communication with the axial direction oil supply groove, the lubricating oil inside the oil supply passage is drawn into the pump chamber by a negative pressure thereinside. If a large amount of lubricating oil is then drawn into the pump chamber, an excessive load is added to the vanes when the vane pump is subsequently started in order to discharge the lubricating oil, which may cause a damage on the vane.

However, in the vane pump having the above-described configuration, when the rotor stops in the state where the diameter direction oil supply hole of the oil supply passage is in communication with the axial direction oil supply groove, the diameter direction gas hole of the gas passage is adapted to communicate with the axial direction gas groove at the same time, so as to allow the air of the outer space to flow into the pump chamber through the gas passage. Hence, since the negative pressure in the pump chamber can be eliminated by allowing the air of the outer space to flow into the pump chamber, a large amount of lubricating oil can be prevented from entering the pump chamber.

Prior Art Documents

Patent Document

Patent Document 1: Japanese Patent Laid-Open No. 2006-226164

SUMMARY OF INVENTION

Problems to be Solved by the Invention

However, in the above-described vane pump, it turned out that when a hydraulic pressure of the lubricating oil supplied from the hydraulic pump to the oil supply passage was low such as at the time of engine idling, the air of the outer space was sucked into the pump chamber from the gas passage, and thereby engine driving torque was increased.

By the way, a passage area of the diameter direction gas hole constituting the gas passage is set to be as small a passage area as possible in order to reduce the leakage of the lubricating oil to the outer space through the gas passage, i.e., to an internal space of an engine when the hydraulic pressure of the lubricating oil supplied from the hydraulic pump to the oil supply passage is high. On the other hand, since the diameter direction gas hole is the hole perforated in a diameter direction of the rotor, a much smaller hole diameter thereof may easily cause the hole to be clogged.

Hence, in the vane pump configured as described above, there has been a certain limit in reducing the passage area of the diameter direction gas hole constituting the gas passage.

Since the axial direction gas groove is a "groove" in contrast with the above-mentioned diameter direction gas hole, clogging thereof is less likely to occur than in a through-hole, thus enabling the reduction of the passage area of the axial direction gas groove compared with the diameter direction gas hole. However, since a width of the axial direction gas groove must be made to correspond to that of the axial direction oil supply groove in a case of a configuration of Patent Document 1, there has been also a certain limit in reducing the passage area of the axial direction gas groove.

To explain this in more detail, since the diameter direction gas hole must be in communication with the axial direction gas groove at the same time when the rotor stops in a state where the diameter direction oil supply hole is in communication with the axial direction oil supply groove, the width of the axial direction gas groove must be certainly set to be a width with which the diameter direction gas hole is in a state of being in communication overlappingly with this axial direction gas groove while the diameter direction oil supply hole is in communication overlappingly with the axial direction oil supply groove. Namely, the width of the axial direction gas groove must be made to correspond to that of the axial direction oil supply groove.

However, the width of the axial direction oil supply groove must be set to be a width with which a required amount of lubricating oil can be supplied to the pump chamber in consideration of an overlap time of the axial direction oil supply groove with the diameter direction oil supply hole that crosses the groove. Hence, the width of this axial direction oil supply groove cannot be made smaller without any reason, and as a result of it, the width of the axial direction gas groove has been unable to be made smaller, either.

In view of such conditions, the present invention provides a vane pump in which the passage area of the gas passage can be set smaller as compared with a conventional vane pump to prevent the air from being sucked in the pump chamber from the gas passage as much as possible, thereby enabling to prevent engine driving torque from increasing.

Means for Solving the Problems

Namely, the present invention is a vane pump including: a housing including a substantially circular pump chamber; a rotor that rotates about a position eccentric with respect to a center of the pump chamber; a vane that is rotated by the rotor and that always partitions the pump chamber into a plurality of spaces; an oil supply passage that intermittently communicates with the pump chamber by the rotation of the rotor; and a gas passage that makes the pump chamber and an outer space communicate with each other when the oil supply passage communicates with the pump chamber by the rotation of the rotor, wherein the oil supply passage includes: a diameter direction oil supply hole provided at a shaft part of the rotor in a diameter direction thereof; and an axial direction oil supply groove that is provided in the housing to communicate with the pump chamber, and with which an opening of the diameter direction oil supply hole is made to intermittently overlappingly communicate by the rotation of the rotor, and wherein the gas passage is comprised of a gas groove whose one end is made to communicate with the outer space, the gas groove being formed on an outer peripheral surface of the rotor, and the other end of this gas groove is made to intermittently overlappingly communicate with the axial direction oil supply groove by the rotation of the rotor.

Advantageous Effects of Invention

In the present invention, the gas passage is comprised of a gas groove whose one end is made to communicate with an outer space, the gas groove being formed on an outer peripheral surface of the rotor. Additionally, since the other end of this gas groove is made to intermittently overlappingly communicate with the axial direction oil supply groove by a rotation of the rotor, it is not necessary to make a width of this gas groove correspond to that of the axial direction oil supply groove as in a conventional apparatus. Namely, since the gas groove has only to communicate with the axial direction oil supply groove at the same time when the rotor stops in the state where the diameter direction oil supply hole is in communication with the axial direction oil supply groove, it is not necessary to make the width of the gas groove correspond to that of the axial direction oil supply groove.

Additionally, as mentioned above, clogging of the groove is less likely to occur than the through-hole, thus enabling the reduction of the passage area of the groove as compared with a conventional diameter direction gas hole. Hence, the air is prevented from being sucked in the pump chamber from the gas passage as much as possible, thus enabling the prevention of the engine driving torque from increasing.

MODE FOR CARRYING OUT THE INVENTION

Figure 1:
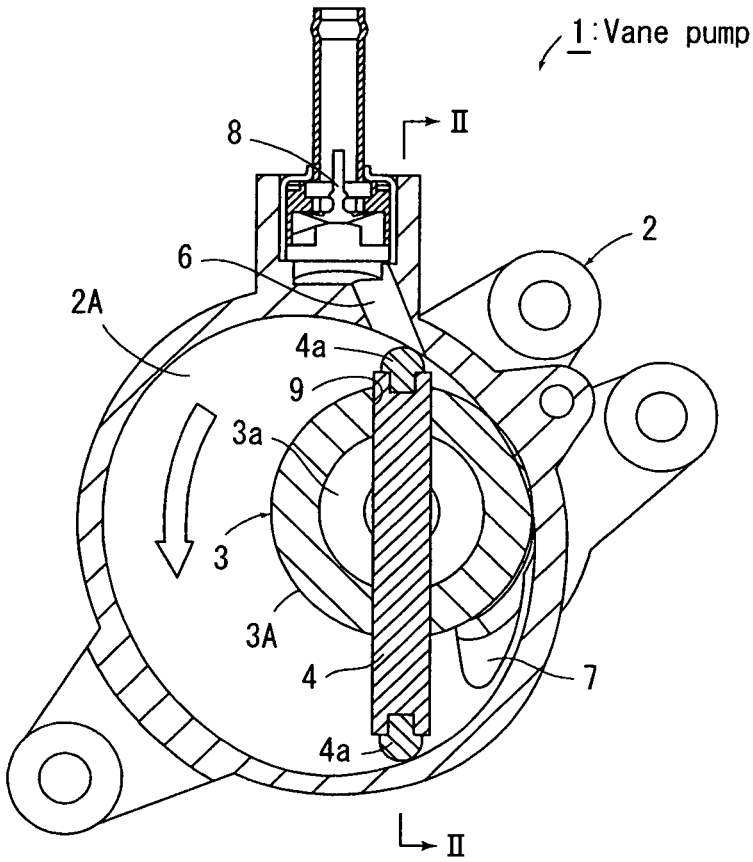
FIG. 1 is an elevational view of a vane pump showing an embodiment of the present invention.
Figure 2:
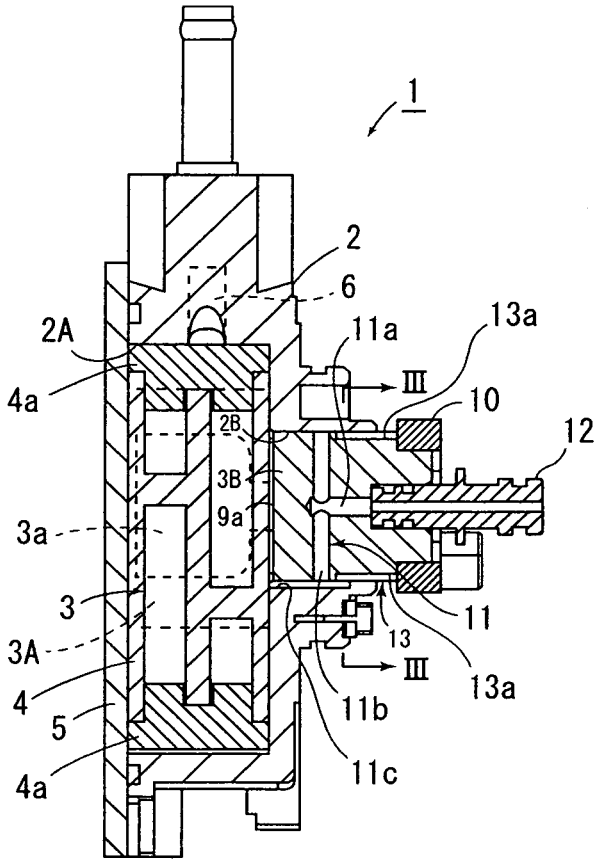
FIG. 2 is a cross-sectional view taken along a line II-II in FIG. 1.

Hereinafter, when describing an embodiment shown in drawings of the present invention, FIGS. 1 and 2 show a vane pump 1 according to the present invention, and this vane pump 1 is fixed to a side surface of an engine of an automobile, which is not shown, to generate a negative pressure in a servo unit for a brake system, which is not shown.

This vane pump 1 includes: a housing 2 in which a substantially circular pump chamber 2A is formed; a rotor 3 that is rotated by an engine drive force about a position eccentric with respect to a center of the pump chamber 2A; a vane 4 that is rotated by the rotor 3 and that always partitions the pump chamber 2A into a plurality of spaces; and a cover 5 that closes the pump chamber 2A.

The housing 2 is provided with an intake air passage 6 that communicates with the servo unit for the brake to suck a gas from the servo unit, the intake air passage 6 being located at an upper part of the pump chamber 2A, and a discharge passage 7 for discharging the gas sucked from the servo unit, the discharge passage 7 being located at a lower part of the pump chamber 2A, respectively. Additionally, the intake air passage 6 is provided with a check valve 8 in order to hold a negative pressure in the servo unit particularly when the engine is stopped.

The rotor 3 includes a cylindrical rotor part 3A that rotates in the pump chamber 2A, an outer periphery of the rotor part 3A is provided so as to contact with an inner peripheral surface of the pump chamber 2A, the intake air passage 6 is located at an upstream side with respect to a rotation of the rotor part 3A, and the discharge passage 7 is formed closer to a downstream side than the rotor part 3A.

In addition, a groove 9 is formed in a diameter direction at the rotor part 3A, and the vane 4 is slidably moved in a direction perpendicular to an axial direction of the rotor 3 along the groove 9. Additionally, a lubricating oil from an oil supply passage, which will be described hereinafter, flows between a hollow part 3*a* formed in a center of the rotor part 3A and the vane 4.

Further, caps 4*a* are provided at both ends of the vane 4, and the pump chamber 2A is always partitioned into two or three spaces by rotating these caps 4*a* while always sliding them on the inner peripheral surface of the pump chamber 2A.

Specifically, the pump chamber 2A is partitioned by the vane 4 into an illustrated horizontal direction in a state of FIG. 1, further, the pump chamber is partitioned by the rotor part 3A into a vertical direction in a space of an illustrated right side, and therefore, the pump chamber 2A is partitioned into a total of three spaces.

When the vane 4 rotates to the vicinity of a position connecting the center of the pump chamber 2A and a rotation center of the rotor 3 by the rotation of the rotor 3 from this state of FIG. 1, the pump chamber 2A is partitioned into two spaces: a space of an intake air passage 6 side; and a space of a discharge passage 7 side.

FIG. 2 shows a cross-sectional view of a II-II part in the above-described FIG. 1, a bearing part 2B for pivotally supporting a shaft part 3B constituting the rotor 3 is formed at an illustrated right side of the pump chamber 2A in the housing 2, and the shaft part 3B rotates integrally with the rotor part 3A.

In addition, the cover 5 is provided at a left end of the pump chamber 2A, the rotor part 3A and an end surface of an illustrated left side of the vane 4 rotate slidingly contacting with this cover 5, and additionally, an end surface of a right side of the vane 4 rotates slidingly contacting with an inner surface of a bearing part 2B side of the pump chamber 2A.

In addition, a bottom surface 9*a* of the groove 9 formed in the rotor 3 is formed slightly closer to a shaft part 3B side than the surface with which the pump chamber 2A and the vane 4 slidingly contact, and a gap is formed between the vane 4 and the bottom surface 9*a*.

Further, the shaft part 3B projects to the illustrated right side more than the bearing part 2B of the housing 2, couplings 10 rotated by an engine cam shaft are coupled at this projecting position, and the rotor 3 is rotated by a rotation of the cam shaft.

Additionally, an oil supply passage 11 through which the lubricating oil is flowed is formed at the shaft part 3B, and this oil supply passage 11 is connected to a hydraulic pump driven by an engine, which is not shown, through an oil supply pipe 12.

The oil supply passage 11 includes: an axial direction oil supply hole 11*a* formed in an axial direction of the shaft part 3B; and a diameter direction oil supply hole 11*b* perforated in a diameter direction of the shaft part 3B, the hole 11*b* communicating with this axial direction oil supply hole 11*a*.

In addition, at the bearing part 2B of the housing 2, formed is an axial direction oil supply groove 11*c* constituting the oil supply passage 11 formed so as to make the pump chamber 2A and the diameter direction oil supply hole 11*b* communicate with a sliding part with the shaft part 3B. In the embodiment, only one axial direction oil supply groove 11*c* is formed at a lower side of the bearing part 2B shown in FIG. 2, a left end of the axial direction oil supply groove 11*c* communicates with an inside of the pump chamber 2A, and a right end thereof is closed at a position of a right side from an opening of the diameter direction oil supply hole 11*b* by only a requirement.

According to this configuration, when an opening of the diameter direction oil supply hole 11*b* overlaps and communicates with the axial direction oil supply groove 11*c* as shown in FIG. 2, the lubricating oil from the axial direction oil supply hole 11*a* flows into the pump chamber 2A through the diameter direction oil supply hole 11*b* and the axial direction oil supply groove 11*c*, and then flows into the hollow part 3*a* of the rotor 3 from the gap between the vane 4 and the bottom surface 9*a* of the groove 9.

Additionally, the vane pump 1 of the embodiment includes a gas passage 13 that makes the pump chamber 2A communicate with an outer space when the oil supply passage 11 is made to communicate with the pump chamber 2A by the rotation of the rotor 3, and more specifically, when the opening of the diameter direction oil supply hole 11*b* overlaps the axial direction oil supply groove 11*c*.

The gas passage 13 includes two gas grooves 13*a* and 13*a* formed on an outer peripheral surface of a shaft part 3B of the rotor 3, each of the gas grooves 13*a* and 13*a* extends in a right direction shown in FIG. 2 along an axial direction of the shaft part 3B from a position adjacent to the opening of the diameter direction oil supply hole 11*b*, and a right end of the each gas groove 13*a* is in communication with the outer space.

On the other hand, although a left end of each of the gas grooves 13*a* and 13*a* is closed at an adjacent position short of the opening of the diameter direction oil supply hole 11*b* without communicating therewith, the left end of each of the gas grooves 13*a* and 13*a* can be intermittently overlapped with the right end of the axial direction oil supply groove 11*c* closed at the position of the right side from the opening of the diameter direction oil supply hole 11*b* by only the requirement.

Namely, a formation position of the gas groove 13*a* is provided at the same position as the opening of the axial direction oil supply hole 11*b* with respect to a circumferential direction of the shaft part 3B, whereby the diameter direction oil supply hole 11*b* of the oil supply passage 11 communicates with the axial direction oil supply groove 11*c*, and the gas groove 13*a* also communicates with the axial direction oil supply groove 11*c*.

Figure 3:
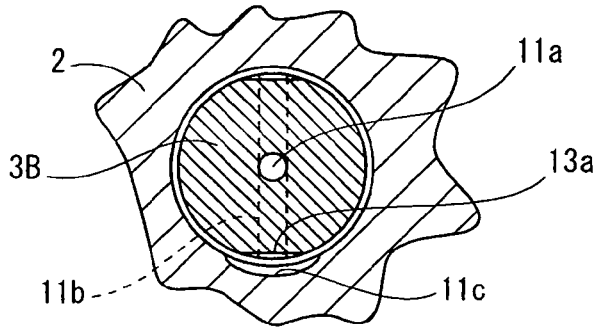
FIG. 3 is a cross-sectional view taken along a Line III-III in FIG. 2.

FIG. 3 is a cross-sectional view in a III-III portion in FIG. 2, and as shown in FIG. 3, each gas groove 13*a* is formed to be a D shape in a cross section by planning the outer peripheral surface of the shaft part 3B in the embodiment, but the width of the gas groove 13*a* is formed smaller enough than the width of the axial direction oil supply groove 11*c* without being affected by the width thereof, and thereby a passage area of the gas groove 13*a* is set smaller as compared with the diameter direction gas hole of the conventional apparatus.

On the other hand, it is preferable that the width of each gas groove 13*a* is formed larger than that (diameter) of the opening of the diameter direction oil supply hole 11*b* based on the circumferential direction of the shaft part 3B, and that it is formed extending to positions anterior to and posterior to both end edges of the opening of the diameter direction oil supply hole 11*b*. If the width of each gas groove 13*a* is set as described above, the gas groove 13*a* can be reliably made to communicate with the axial direction oil supply groove 11*c* even though a rotation is stopped in a state where the opening of the diameter direction oil supply hole 11*b* slightly communicates with the axial direction oil supply groove 11*c*.

Figure 4:
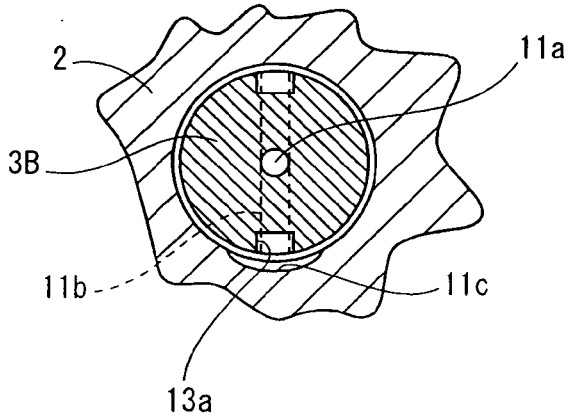
FIG. 4 is a cross-sectional view in a portion similar to FIG. 3 showing a second embodiment of the present invention.
Figure 5:
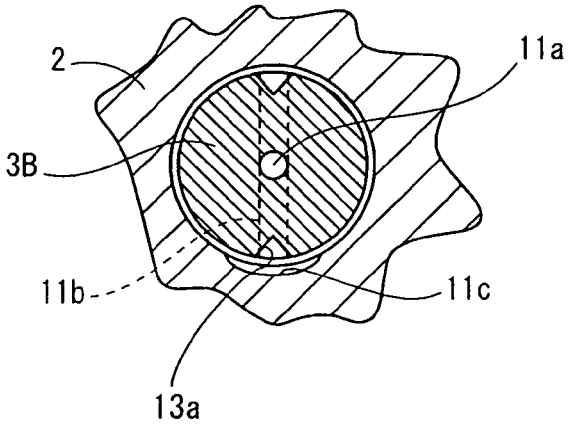
FIG. 5 is a cross-sectional view in the portion similar to FIG. 3 showing a third embodiment of the present invention.

Although a cross-sectional shape of the gas groove 13*a* is not limited to the above-mentioned D shape in the cross section, and it may be an appropriate cross-sectional shape, such as a quadrangular shape in the cross section shown in FIG. 4 and a triangular shape in the cross section shown in FIG. 5, in any case, it is preferable that a relation between the width of each gas groove 13*a* and the opening of the diameter direction oil supply hole 11*b* is set as described above.

Although it goes without saying that the gas grooves 13*a* of the respective shapes can be formed by cutting after manufacturing the rotor 3, respectively, it is preferable to form the gas groove 13*a* at the same time as the manufacturing of the rotor 3 when the rotor 3 is manufactured by forging or sintering, thereby enabling to achieve reduction in manufacturing cost.

To explain the operations of the vane pump 1 having the above-described configuration hereinafter, similarly to a conventional vane pump 1, when the rotor 3 is rotated by actuation of the engine, the vane 4 also rotates reciprocating in the groove 9 of the rotor 3 along with the actuation, and a volume of a space of the pump chamber 2A partitioned by the vane 4 changes according to the rotation of the rotor 3.

As a result of it, a volume in a space of the intake air passage 6 side partitioned by the vane 4 increases to generate a negative pressure in the pump chamber 2A, and a gas is sucked from the servo unit through the intake air passage 6 to generate a negative pressure in the servo unit. Additionally, the sucked gas is then compressed due to decrease of a volume of a space of the discharge passage 7 side, and it is discharged from the discharge passage 7.

Meanwhile, when the vane pump 1 is started, the lubricating oil is supplied to the oil supply passage 11 from the hydraulic pump driven by the engine through the oil supply pipe 12, and this lubricating oil flows into the pump chamber 2A when the diameter direction oil supply hole 11*b* and the axial direction oil supply groove 11*c* of the housing 2 communicate with each other by the rotation of the rotor 3.

The lubricating oil having flowed into the pump chamber 2A flows into the hollow part 3*a* of the rotor part 3A from the gap between the bottom surface 9*a* of the groove 9 part formed at the rotor part 3A and the vane 4, this lubricating oil spouts in the pump chamber 2A from a gap between the rotor part 3A and the groove 9, and from a gap between the vane 4 and the cover 5 to lubricate these gaps and to seal the pump chamber 2A, and after that, the lubricating oil is discharged from the discharge passage 7 along with the gas.

When the engine is stopped from the above-described operational state, the rotor 3 stops according to the engine stop, and air intake from the servo unit finishes.

Here, although the space of the intake air passage 6 side partitioned by the vane 4 stops remained in a negative pressure state by the stop of the rotor 3, if the opening of the diameter direction oil supply hole 11*b* and the axial direction oil supply groove 11*c* do not correspond to each other at this time, the lubricating oil in the axial direction oil supply hole 11*a* does not flow into the pump chamber 2A.

In contrast with this, when the rotor 3 stops in a state where the opening of the diameter direction oil supply hole 11*b* and the axial direction oil supply groove 11*c* correspond to each other, a large amount of lubricating oil in the oil supply passage 11 tends to flow into the pump chamber 2A due to the negative pressure in the pump chamber 2A.

However, since the gas groove 13*a* corresponds to the axial direction oil supply groove 11*c* at the same time when the opening of the diameter direction oil supply hole 11*b* and the axial direction oil supply groove 11*c*correspond to each other, the atmosphere flows into the pump chamber 2A from this gas hole 13*a* to eliminate the negative pressure therein, thereby enabling the prevention of a large amount of lubricating oil from flowing into the pump chamber 2A.

Figure 6:
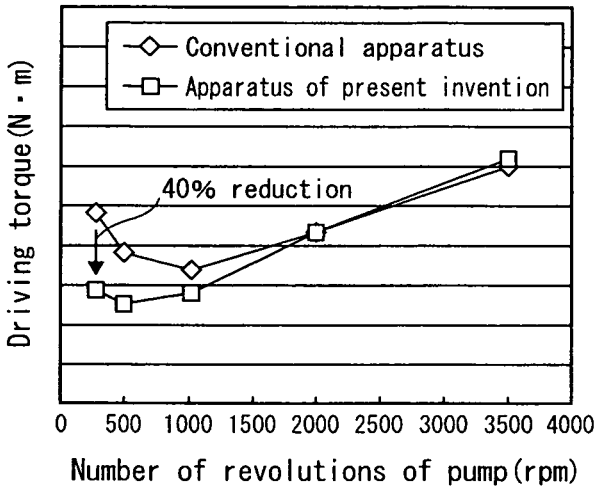
FIG. 6 is a test result graph obtained by testing a relation between the number of revolutions and driving torque.

FIG. 6 is a test result graph obtained by testing relations between the number of revolutions and driving torque, and ◇ marks indicate the conventional apparatus, and □ marks indicate the apparatus of the present invention. In FIG. 6, a gas passage of the conventional apparatus includes a diameter direction gas hole, and a diameter of the gas hole is set to be minimum 1.5 millimeters in consideration of preventing clogging, thus resulting in 1.77 $mm^2$ of passage area of the conventional gas passage.

In contrast with this, since the gas passage 13 of the present invention is the groove-shaped gas groove 13*a* having the cross-sectional shape shown in FIGS. 3 to 5, clogging thereof does not easily occur as compared with a conventional hole shape, and thus the passage area of the gas passage 13 is set to be 0.91 $mm^2$, which is smaller than the passage area of the conventional gas passage. It is to be noted that although the gas groove 13*a* of the D shape in the cross section shown in FIG. 3 was used for the test, equivalent test results have been obtained also when using the other cross-sectional shapes.

As can be understood from the above-described test results, driving torque increases as the number of revolutions of the engine becomes not more than 1000 revolutions in the conventional apparatus (◇). This is because an amount of air sucked in the pump chamber 2A increases as the number of revolutions of the engine becomes not more than 1000 revolutions, the air sucked along with the rotation of the vane 4 is again discharged to an outside of the pump chamber 2A, and thereby the driving torque becomes larger along with the increase of the amount of air sucked in the pump chamber 2A.

When the passage area of the gas hole 13*a* is reduced as in the example of the present invention (□) in contrast with the above-described conventional apparatus, an increase of the driving torque can be suppressed even though the number of revolutions of the engine decreases. This shows that the amount of air sucked in the pump chamber 2A can be reduced.

Note that it goes without saying that although the above-described embodiment has been described using the vane pump 1 including a sheet of vane 4, a conventionally known vane pump 1 including a plurality of vanes 4 is also applicable and, additionally, an application of the vane pump 1 is not limited to generate a negative pressure in a servo unit.

REFERENCE SIGNS LIST

1 Vane pump
2 Housing
2A Pump chamber
2B Bearing part
3 Rotor
3A Rotor part
3B Shaft part
4 Vane
11 Oil supply passage
11*a* Axial direction oil supply hole
11*b* Diameter direction oil supply hole
11*c* Axial direction oil supply groove
13 Gas passage
13*a* Gas groove

The invention claimed is:

1. A vane pump comprising: a housing comprising a substantially circular pump chamber; a rotor that rotates about a position eccentric with respect to a center of the pump chamber; a vane that is rotated by the rotor and that always partitions the pump chamber into a plurality of spaces; an oil supply passage that intermittently communicates with the pump chamber by the rotation of the rotor; and a gas passage that makes the pump chamber and an outer space communicate with each other when the oil supply passage communicates with the pump chamber by the rotation of the rotor, wherein the oil supply passage further comprises: a diameter direction oil supply hole provided at a shaft part of the rotor in a diameter direction thereof; and an axial direction oil supply groove that is provided in the housing to communicate with the pump chamber, and with which an opening of the diameter direction oil supply hole is made to intermittently overlappingly communicate by the rotation of the rotor, the gas passage comprises a gas groove whose one end is made to communicate with the outer space, the gas groove being formed on an outer peripheral surface of the rotor, and the other end of said gas groove is made to intermittently overlappingly communicate with the axial direction oil supply groove by the rotation of the rotor, a width of the gas groove is formed larger than that of the opening of the diameter direction oil supply hole based on a circumferential direction of the shaft part of the rotor, is also formed extending to positions anterior to and posterior to both end edges of the opening of the diameter direction oil supply hole, and is also formed smaller than a width of the axial direction oil supply groove, and the gas groove communicates with the axial direction oil supply groove when the rotation of the rotor is stopped in a state where the opening of the diameter direction oil supply hole slightly communicates with the axial direction oil supply groove.

2. The vane pump according to claim 1, wherein a cross-sectional shape of the gas groove is any of a D shape in a cross section formed by planing the outer peripheral surface of the shaft part of the rotor, a quadrangular shape in the cross section, and a triangular shape in the cross section.

3. The vane pump according to claim 1, wherein the gas groove is formed at the same time when manufacturing the rotor.

* * * * *